US011365672B2

(12) United States Patent
Chang et al.

(10) Patent No.: US 11,365,672 B2
(45) Date of Patent: Jun. 21, 2022

(54) INTERNAL COMBUSTION ENGINE COOLANT FLOW CONTROL

(71) Applicant: GM GLOBAL TECHNOLOGY OPERATIONS LLC, Detroit, MI (US)

(72) Inventors: Insu Chang, Troy, MI (US); Min Sun, Troy, MI (US); David E. Edwards, Rochester Hills, MI (US)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 149 days.

(21) Appl. No.: 16/707,290

(22) Filed: Dec. 9, 2019

(65) Prior Publication Data

US 2021/0172369 A1 Jun. 10, 2021

(51) Int. Cl.

| | |
|---|---|
| ***F01P 7/16*** | (2006.01) |
| ***F01P 5/10*** | (2006.01) |
| *F01P 7/14* | (2006.01) |

(52) U.S. Cl.

CPC ..... *F01P 7/16* (2013.01); *F01P 5/10* (2013.01); *F01P 2007/146* (2013.01); *F01P 2025/31* (2013.01); *F01P 2025/32* (2013.01); *F01P 2025/40* (2013.01)

(58) Field of Classification Search

CPC ..... F01P 7/16; F01P 5/10; F01P 2007/146; F01P 2025/31; F01P 2025/32; F01P 2025/40

USPC ..... 701/113

See application file for complete search history.

(56) References Cited

U.S. PATENT DOCUMENTS

| | | | | |
|---|---|---|---|---|
| 5,931,140 | A * | 8/1999 | Maloney | F02D 41/0072 73/114.37 |
| 6,688,263 | B1 * | 2/2004 | Yamamoto | F02B 77/089 123/41.57 |
| 2007/0272173 | A1 * | 11/2007 | Reckels | G16Z 99/00 123/41.11 |
| 2011/0098883 | A1 * | 4/2011 | Eser | F01P 5/14 701/33.4 |
| 2013/0156065 | A1 * | 6/2013 | Graf | F01P 5/14 374/145 |
| 2014/0072450 | A1 * | 3/2014 | Levijoki | F04B 51/00 417/42 |
| 2016/0333769 | A1 * | 11/2016 | Reichenbach | F01P 3/20 |
| 2017/0002721 | A1 * | 1/2017 | Naik | F01P 7/164 |

(Continued)

FOREIGN PATENT DOCUMENTS

GB 390837 A 4/1933

OTHER PUBLICATIONS

Heywood, John B. "Internal combustion engine fundamentals" (1988) pp. 676-679.

(Continued)

*Primary Examiner* — Logan M Kraft
*Assistant Examiner* — John D Bailey
(74) *Attorney, Agent, or Firm* — Cantor Colburn LLP

(57) ABSTRACT

An internal combustion engine includes an engine block, a combustion cylinder including a cylinder wall, engine oil and engine coolant. Control of the internal combustion engine includes estimating the cylinder wall temperature in a temperature state estimator, comparing the estimated cylinder wall temperature to a predetermined temperature threshold, and circulating the engine coolant in the engine when the estimated cylinder wall temperature exceeds the predetermined temperature threshold.

14 Claims, 3 Drawing Sheets

(56) References Cited

U.S. PATENT DOCUMENTS

| | | | | |
|---|---|---|---|---|
| 2017/0204774 | A1* | 7/2017 | Gonze | F01P 3/20 |
| 2018/0245504 | A1* | 8/2018 | Murai | F01P 7/167 |
| 2021/0061063 | A1* | 3/2021 | Sun | B60H 1/00735 |

OTHER PUBLICATIONS

Chinese Office Action for Chinese Application No. 202011441651.6; Report dated Mar. 30, 2022 (pp. 1-8).

* cited by examiner

INTERNAL COMBUSTION ENGINE COOLANT FLOW CONTROL

Internal combustion engines operate inefficiently before the combustion chamber and surrounding components reach a certain optimal temperature range. Therefore, it is desirable to reach the optimal temperature range as quickly as possible to improve combustion efficiency, engine out emissions, and quicker catalyst light off in the exhaust gas aftertreatment system. To this end, it is known to capture exhaust heat from exhaust conduits by integrating exhaust manifold with cylinder head. It is also known to delay circulation of coolant around the cylinder to avoid dissipating heat from cylinder wall and minimize time to reach optimal combustion temperatures. However, overshooting the optimal temperature range may cause engine coolant to boil and cause undesirable pressure events within the closed cooling system. Cylinder wall temperature provides one of the best measures of combustion chamber temperature conditions. However, outside of a development environment, it is impractical to measure cylinder wall temperature directly.

SUMMARY

In one exemplary embodiment, an internal combustion engine includes an engine block, a combustion cylinder including a cylinder wall, engine oil and engine coolant. A method for controlling the internal combustion engine includes estimating the cylinder wall temperature in a temperature state estimator, comparing the estimated cylinder wall temperature to a predetermined temperature threshold, and circulating the engine coolant in the engine when the estimated cylinder wall temperature exceeds the predetermined temperature threshold.

In addition to one or more of the features described herein, the temperature state estimator includes a plurality of temperature dynamics relationships based upon modeled heat transfers within the internal combustion engine.

In addition to one or more of the features described herein, the modeled heat transfers within the internal combustion engine include heat transfer from combustion gas to the cylinder wall ($\dot{Q}_{g,w}^{eng}$) heat transfer from the cylinder wall to the engine coolant ($\dot{Q}_{w,c}^{end}$) heat transfer from the cylinder wall to the engine oil ($\dot{Q}_{w,o}^{eoh}$), heat transfer from the engine coolant to the engine block ($\dot{Q}_{c,b}^{eng}$), heat transfer from the engine block to ambient air ($\dot{Q}_{b,a}^{eng}$) and heat transfer from the engine oil to the engine block ($\dot{Q}_{o,b}^{eoh}$).

In addition to one or more of the features described herein, the plurality of temperature dynamics relationships includes a cylinder wall temperature dynamics relationship including a combustion gas to cylinder wall heat transfer term based upon the fraction of an adiabatic temperature increase within the cylinder contributing to a combustion gas temperature increase within the cylinder.

In addition to one or more of the features described herein, the plurality of temperature dynamics relationships includes a cylinder wall temperature dynamics relationship $m_w^{eng}c_{pw}^{eng}\dot{T}_w^{eng}=-\dot{Q}_{w,c}^{eng}-\dot{Q}_{w,o}^{eoh}+\dot{Q}_{g,w}^{eng}$ wherein $m_w^{eng}$ includes the mass of the cylinder wall, $c_{pw}^{eng}$ includes the specific heat of the cylinder wall, $T_w^{eng}$ includes cylinder wall temperature, $\dot{Q}_{w,c}^{eng}$ includes heat transfer from the cylinder wall to the engine coolant, $\dot{Q}_{w,o}^{eoh}$ includes heat transfer from the cylinder wall to the engine oil, and $\dot{Q}_{g,w}^{eng}$ includes heat transfer from combustion gas to the cylinder wall.

In addition to one or more of the features described herein, heat transfer from the combustion gas to the cylinder wall, $\dot{Q}_{g,w}^{eng}$, is determined in accordance with $$\frac{\pi B k_g}{4} a Re^b (T_{g,corr} - T_w^{eng})$$

wherein B includes the cylinder bore diameter, $k_g$ includes the thermal conductivity of the cylinder wall, Re includes the Reynolds number, a and b include engine specific parameters, and $T_{g,corr}$ includes a combustion gas temperature correction term based in part upon the fraction of an adiabatic temperature increase within the cylinder contributing to a combustion gas temperature increase within the cylinder.

In addition to one or more of the features described herein, the plurality of temperature dynamics relationships includes a cylinder wall temperature dynamics relationship $m_w^{eng}c_{pw}^{eng}\dot{T}_w^{eng}=-\dot{Q}_{w,c}^{eng}-\dot{Q}_{w,o}^{eoh}+\dot{Q}_{g,w}^{eng}$ wherein $m_w^{eng}$ includes the mass of the cylinder wall, $c_{pw}^{eng}$ includes the specific heat of the cylinder wall, $T_w^{eng}$ includes cylinder wall temperature, $\dot{Q}_{w,c}^{eng}$ includes heat transfer from the cylinder wall to the engine coolant, $Q_{w,o}^{eoh}$ includes heat transfer from the cylinder wall to the engine oil, and $\dot{Q}_{g,w}^{eng}$ includes heat transfer from combustion gas to the cylinder wall. The plurality of temperature dynamics relationships includes an engine coolant out temperature dynamics relationship $m_c^{eng}c_{pc}^{eng}\dot{T}_{c,out}^{eng}=\dot{Q}_{w,c}^{eng}-\dot{Q}_{c,b}^{eng}$ wherein $m_c^{eng}$ includes the mass of the engine coolant in the passages surrounding the cylinder wall, $c_{pc}^{eng}$ includes the specific heat of the engine coolant, $T_{c,out}^{eng}$ includes engine coolant out temperature, $\dot{Q}_{w,c}^{eng}$ includes heat transfer from the cylinder wall to the engine coolant, and $\dot{Q}_{c,b}^{eng}$ includes heat transfer from the engine coolant to the engine block. The plurality of temperature dynamics relationships includes an engine block temperature dynamics relationship $m_b^{eng}c_{pb}^{eng}\dot{T}_b^{eng}=\dot{Q}_{c,b}^{eng}+\dot{Q}_{o,b}^{eoh}-\dot{Q}_{b,a}^{eng}$ wherein $m_b^{eng}$ includes the mass of the engine block, $c_{pb}^{eng}$ includes the specific heat of the engine block, $T_b^{eng}$ includes engine block temperature, $\dot{Q}_{c,b}^{eng}$ includes heat transfer from the engine coolant to the engine block, $\dot{Q}_{o,b}^{eoh}$ includes heat transfer from the engine oil to the engine block, and $\dot{Q}_{b,a}^{eng}$ includes heat transfer from the engine block to ambient air. The plurality of temperature dynamics relationships includes an engine oil temperature dynamics relationship $m_o^{eoh}c_{po}^{eng}\dot{T}_o^{eoh}=\dot{Q}_{w,o}^{eoh}+\dot{Q}_{c,o}^{eoh}+\dot{Q}_{b,o}^{eoh}+S_{fric}$ wherein $m_o^{eoh}$ includes the mass of the engine oil, $c_{po}^{eng}$ includes the specific heat of the engine oil, $T_o^{eoh}$ includes engine oil temperature, $\dot{Q}_{w,o}^{eoh}$ includes heat transfer from cylinder wall to engine oil $\dot{Q}_{c,o}^{eng}$ includes heat transfer from engine coolant to engine oil, $\dot{Q}_{b,o}^{eoh}$ includes heat transfer from engine block to engine oil, and $S_{fric}$ includes heat from mechanical friction imparted to the engine oil.

In addition to one or more of the features described herein, heat transfer from the combustion gas to the cylinder wall, $\dot{Q}_{g,w}^{eng}$, is determined in accordance with $$\frac{\pi B k_g}{4} a Re^b (T_{g,corr} - T_w^{eng})$$

wherein B includes the cylinder bore diameter, $k_g$ includes the thermal conductivity of the cylinder wall, Re includes the Reynolds number, a and b include engine specific parameters, and $T_{g,corr}$ includes a combustion gas temperature correction term based in part upon the fraction of an adiabatic temperature increase within the cylinder contributing to a combustion gas temperature increase within the cylinder.

In another exemplary embodiment, an internal combustion engine includes an engine block, a combustion cylinder including a cylinder wall, engine oil and engine coolant. A method for controlling the internal combustion engine includes modeling the internal combustion engine as a plurality of heat transfers, defining a plurality of temperature state equations based upon the plurality of heat transfers, measuring a plurality of temperature state variables, implementing, within a controller, a thermal state model including the plurality of temperature state equations including receiving the plurality of temperature state variables and providing an estimated cylinder wall temperature, and controlling engine coolant flow in the internal combustion engine based upon the estimated cylinder wall temperature.

In addition to one or more of the features described herein, the plurality heat transfers include heat transfer from combustion gas to the cylinder wall ($\dot{Q}_{g,w}^{eng}$), heat transfer from the cylinder wall to the engine coolant ($\dot{Q}_{w,c}^{eng}$), heat transfer from the cylinder wall to the engine oil ($\dot{Q}_{w,o}^{eoh}$), heat transfer from the engine coolant to the engine block ($\dot{Q}_{c,b}^{eng}$) heat transfer from the engine block to ambient air ($\dot{Q}_{b,a}^{eng}$), and heat transfer from the engine oil to the engine block ($\dot{Q}_{o,b}^{eoh}$).

In addition to one or more of the features described herein, the plurality of temperature state equations incudes a cylinder wall temperature state equation $m_w^{eng}c_{pw}^{eng}\dot{T}_w^{eng}=-\dot{Q}_{w,c}^{eng}-\dot{Q}_{w,o}^{eoh}+\dot{Q}_{g,w}^{eng}$ wherein $m_w^{eng}$ includes the mass of the cylinder wall, $c_{pw}^{eng}$ includes the specific heat of the cylinder wall, $T_w^{eng}$ includes cylinder wall temperature, $\dot{Q}_{w,c}^{eng}$ includes heat transfer from the cylinder wall to the engine coolant, $\dot{Q}_{w,o}^{eoh}$ includes heat transfer from the cylinder wall to the engine oil, and $\dot{Q}_{g,w}^{eng}$ includes heat transfer from combustion gas to the cylinder wall.

In addition to one or more of the features described herein, heat transfer from the combustion gas to the cylinder wall, $\dot{Q}_{g,w}^{eng}$ is determined in accordance with $$\frac{\pi B k_g}{4} a Re^b (T_{g,corr} - T_w^{eng})$$

wherein B includes the cylinder bore diameter, $k_g$ includes the thermal conductivity of the cylinder wall, Re includes the Reynolds number, a and b include engine specific parameters, and $T_{g,corr}$ includes a combustion gas temperature correction term based in part upon the fraction of an adiabatic temperature increase within the cylinder contributing to a combustion gas temperature increase within the cylinder.

In addition to one or more of the features described herein, the plurality of temperature state equations includes a cylinder wall temperature state equation $m_w^{eng}c_{pw}^{eng}\dot{T}_w^{eng}=-\dot{Q}_{w,c}^{eng}-\dot{Q}_{w,o}^{eoh}+\dot{Q}_{g,w}^{eng}$ wherein $m_w^{eng}$ includes the mass of the cylinder wall, $c_{pw}^{eng}$ includes the specific heat of the cylinder wall, $T_w^{eng}$ includes cylinder wall temperature, $\dot{Q}_{w,c}^{eng}$ includes heat transfer from the cylinder wall to the engine coolant, $\dot{Q}_{w,o}^{eoh}$ includes heat transfer from the cylinder wall to the engine oil, and $\dot{Q}_{g,w}^{eng}$ includes heat transfer from combustion gas to the cylinder wall. The plurality of temperature state equations includes an engine coolant out temperature state equation $m_c^{eng}c_{pc}^{eng}\dot{T}_{c,out}^{eng}=\dot{Q}_{w,c}^{eng}-\dot{Q}_{c,b}^{eng}$ wherein $m_c^{eng}$ includes the mass of the engine coolant in the passages surrounding the cylinder wall, $c_{pc}^{eng}$ includes the specific heat of the engine coolant, $T_{c,out}^{eng}$ includes engine coolant out temperature, $\dot{Q}_{w,c}^{eng}$ includes heat transfer from the cylinder wall to the engine coolant, and $\dot{Q}_{c,b}^{eng}$ includes heat transfer from the engine coolant to the engine block. The plurality of temperature state equations includes an engine block temperature state equation $m_b^{eng}c_{pb}^{eng}\dot{T}_b^{eng}=\dot{Q}_{c,b}^{eng}+\dot{Q}_{o,b}^{eoh}-\dot{Q}_{b,a}^{eng}$ wherein $m_b^{eng}$ includes the mass of the engine block, $c_{pb}^{eng}$ includes the specific heat of the engine block, $T_b^{eng}$ includes engine block temperature, $\dot{Q}_{c,b}^{eng}$ includes heat transfer from the engine coolant to the engine block, $\dot{Q}_{o,b}^{eoh}$ includes heat transfer from the engine oil to the engine block, and $\dot{Q}_{b,a}^{eng}$ includes heat transfer from the engine block to ambient air. The plurality of temperature state equations includes an engine oil temperature state equation $m_o^{eoh}c_{po}^{eng}\dot{T}_o^{eoh}=\dot{Q}_{w,o}^{eoh}+\dot{Q}_{b,o}^{eoh}+S_{fric}$ wherein $m_o^{eoh}$ includes the mass of the engine oil, $c_{po}^{eng}$ includes the specific heat of the engine oil, $T_o^{eoh}$ includes engine oil temperature, $\dot{Q}_{w,o}^{eoh}$ includes heat transfer from cylinder wall to engine oil, $\dot{Q}_{c,o}^{eng}$ includes heat transfer from engine coolant to engine oil, $\dot{Q}_{b,o}^{eoh}$ includes heat transfer from engine block to engine oil, and $S_{fric}$ includes heat from mechanical friction imparted to the engine oil.

In addition to one or more of the features described herein, heat transfer from the combustion gas to the cylinder wall, $\dot{Q}_{g,w}^{eng}$, is determined in accordance with $$\frac{\pi B k_g}{4} a Re^b (T_{g,corr} - T_w^{eng})$$

wherein B includes the cylinder bore diameter, $k_g$ includes the thermal conductivity of the cylinder wall, Re includes the Reynolds number, a and b include engine specific parameters, and $T_{g,corr}$ includes a combustion gas temperature correction term based in part upon the fraction of an adiabatic temperature increase within the cylinder contributing to a combustion gas temperature increase within the cylinder.

In yet another exemplary embodiment, an internal combustion engine includes an engine block, a combustion cylinder including a cylinder wall, engine oil and engine coolant. An apparatus for controlling the internal combustion engine includes an engine coolant pump, an engine block temperature sensor for measuring an engine block temperature, an engine coolant out temperature sensor for measuring an engine coolant out temperature, and an engine oil temperature sensor for measuring an engine oil temperature. A control module executes a thermal state model including the engine block temperature, the engine coolant out temperature and the engine oil temperature as state variable inputs. The thermal state model includes a plurality of temperature state equations including a cylinder wall temperature state equation including a combustion gas to a cylinder wall heat transfer term based upon a combustion adiabatic efficiency, the thermal state model providing an estimated cylinder wall temperature. The control module controls the engine coolant pump based upon the estimated cylinder wall temperature.

In addition to one or more of the features described herein, the plurality of temperature state equations incudes a cylinder wall temperature state equation $m_w^{eng}c_{pw}^{eng}\dot{T}_w^{eng}=-\dot{Q}_{w,c}^{eng}-\dot{Q}_{w,o}^{eoh}+\dot{Q}_{g,w}^{eng}$ wherein $m_w^{eng}$ includes the mass of the cylinder wall, $c_{pw}^{eng}$ includes the specific heat of the cylinder wall, $T_w^{eng}$ includes cylinder wall temperature, $\dot{Q}_{w,c}^{eng}$ includes heat transfer from the cylinder wall to the engine coolant, $\dot{Q}_{w,o}^{eoh}$ includes heat transfer from the cylinder wall to the engine oil, and $\dot{Q}_{g,w}^{eng}$ includes heat transfer from combustion gas to the cylinder wall.

In addition to one or more of the features described herein, heat transfer from the combustion gas to the cylinder wall, $\dot{Q}_{g,w}^{eng}$, is determined in accordance with $$\frac{\pi B k_g}{4} a Re^b (T_{g,corr} - T_w^{eng})$$

wherein B includes the cylinder bore diameter, $k_g$ includes the thermal conductivity of the cylinder wall, Re includes the Reynolds number, a and b include engine specific parameters, and $T_{g,corr}$ includes a combustion gas temperature correction term based in part upon the fraction of an adiabatic temperature increase within the cylinder contributing to a combustion gas temperature increase within the cylinder.

In addition to one or more of the features described herein, the plurality of temperature state equations further includes an engine coolant out temperature state equation, an engine block temperature state equation, and an engine oil temperature state equation.

In addition to one or more of the features described herein, the plurality of temperature state equations includes a cylinder wall temperature state equation $m_w^{eng} c_{cw}^{eng} \dot{T}_w^{eng} = -\dot{Q}_{w,c}^{eng} - \dot{Q}_{w,o}^{eoh} + \dot{Q}_{g,w}^{eng}$ wherein $m_w^{eng}$ includes the mass of the cylinder wall, $c_{pw}^{eng}$ includes the specific heat of the cylinder wall, $T_w^{eng}$ includes cylinder wall temperature, $\dot{Q}_{w,c}^{eng}$ includes heat transfer from the cylinder wall to the engine coolant, $\dot{Q}_{w,o}^{eoh}$ includes heat transfer from the cylinder wall to the engine oil, and $\dot{Q}_{g,w}^{eng}$ includes heat transfer from combustion gas to the cylinder wall. The plurality of temperature state equations includes an engine coolant out temperature state equation $m_c^{eng} c_{pc}^{eng} \dot{T}_{c,out}^{eng} = \dot{Q}_{w,c}^{eng} - \dot{Q}_{c,b}^{eng}$ wherein $m_c^{eng}$ includes the mass of the engine coolant in the passages surrounding the cylinder wall, $c_{pc}^{eng}$ includes the specific heat of the engine coolant, $T_{c,out}^{eng}$ includes engine coolant out temperature, $\dot{Q}_{w,c}^{eng}$ includes heat transfer from the cylinder wall to the engine coolant, and $\dot{Q}_{c,b}^{eng}$ includes heat transfer from the engine coolant to the engine block. The plurality of temperature state equations includes an engine block temperature state equation $m_b^{eng} c_{pb}^{eng} \dot{T}_b^{eng} = \dot{Q}_{c,b}^{eng} + \dot{Q}_{o,b}^{eoh} - \dot{Q}_{b,a}^{eng}$ wherein $m_b^{eng}$ includes the mass of the engine block, $c_{pb}^{eng}$ includes the specific heat of the engine block, $T_b^{eng}$ includes engine block temperature, $\dot{Q}_{c,b}^{eng}$ includes heat transfer from the engine coolant to the engine block, $\dot{Q}_{o,b}^{eoh}$ includes heat transfer from the engine oil to the engine block, and $\dot{Q}_{b,a}^{eng}$ includes heat transfer from the engine block to ambient air. The plurality of temperature state equations includes an engine oil temperature state equation $m_o^{eoh} c_{po}^{eng} \dot{T}_o^{eoh} = \dot{Q}_{w,o}^{eoh} + \dot{Q}_{c,o}^{eoh} + \dot{Q}_{b,o}^{eoh} + s_{fric}$ wherein $m_o^{eoh}$ includes the mass of the engine oil, $c_{po}^{eng}$ includes the specific heat of the engine oil, $T_o^{eoh}$ includes engine oil temperature, $\dot{Q}_{w,o}^{eoh}$ includes heat transfer from cylinder wall to engine oil, $\dot{Q}_{c,o}^{eng}$ includes heat transfer from engine coolant to engine oil, $\dot{Q}_{b,o}^{eoh}$ includes heat transfer from engine block to engine oil, and $S_{fric}$ includes heat from mechanical friction imparted to the engine oil.

In addition to one or more of the features described herein, the thermal state model incudes an extended Kalman filter.

The above features and advantages, and other features and advantages of the disclosure are readily apparent from the following detailed description when taken in connection with the accompanying drawings.

BRIEF DESCRIPTION OF THE DRAWINGS

Other features, advantages and details appear, by way of example only, in the following detailed description, the detailed description referring to the drawings in which.

DETAILED DESCRIPTION

Figure 1:
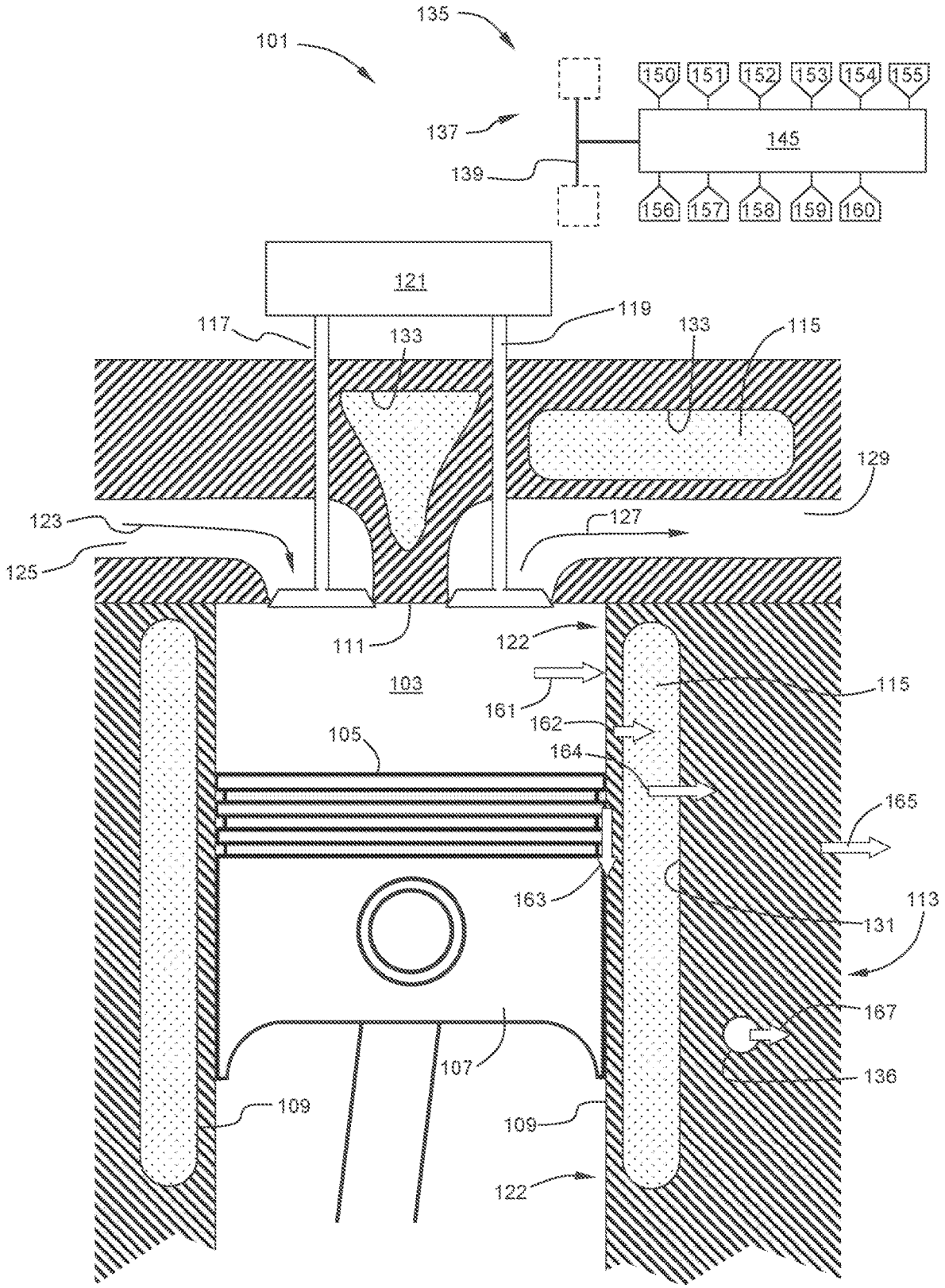
FIG. 1 illustrates an exemplary internal combustion engine system, in accordance with the present disclosure.

The following description is merely exemplary in nature and is not intended to limit the present disclosure, its application or uses. Throughout the drawings, corresponding reference numerals indicate like or corresponding parts and features. As used herein, control module, module, control, controller, control unit, electronic control unit, processor and similar terms mean any one or various combinations of one or more of Application Specific Integrated Circuit(s) (ASIC), electronic circuit(s), central processing unit(s) (preferably microprocessor(s)) and associated memory and storage (read only memory (ROM), random access memory (RAM), electrically programmable read only memory (EPROM), hard drive, etc.) or microcontrollers executing one or more software or firmware programs or routines, combinational logic circuit(s), input/output circuitry and devices (I/O) and appropriate signal conditioning and buffer circuitry, high speed clock, analog to digital (A/D) and digital to analog (D/A) circuitry and other components to provide the described functionality. A control module may include a variety of communication interfaces including point-to-point or discrete lines and wired or wireless interfaces to networks including wide and local area networks, on vehicle controller area networks and in-plant and service-related networks. Functions of the control module as set forth in this disclosure may be performed in a distributed control architecture among several networked control modules. Software, firmware, programs, instructions, routines, code, algorithms and similar terms mean any controller executable instruction sets including calibrations, data structures, and look-up tables. A control module has a set of control routines executed to provide described functions. Routines are executed, such as by a central processing unit, and are operable to monitor inputs from sensing devices and other networked control modules and execute control and diagnostic routines to control operation of actuators. Routines may be executed at regular intervals during ongoing engine and vehicle operation. Alternatively, routines may be executed in response to occurrence of an event, software calls, or on demand via user interface inputs or requests.

FIG. 1 schematically illustrates a single cylinder of an exemplary internal combustion engine system 101. Engine cylinders include a combustion chamber 103 defined by the crown 105 of reciprocating piston 107, cylinder walls 109 and cylinder head 111. Cylinder head 111 is coupled to the engine block 113 and may include a plurality of intake and exhaust valves 117, 119, respectively. An engine cylinder may include one or more of each of the intake and exhaust valves. A valve train 121 including, for example, camshafts, linkages, and phasers (not shown) for operating, including selectively enabling and disabling, the intake and exhaust valves 117,119, is typically associated with the side of the cylinder head opposite the combustion chamber 103. Alternatively, electric or electric-over-hydraulic valve actuation systems are known which perform the intake and exhaust valve actuation functions. Intake air 123 is ingested into the combustion chamber 103 through intake runner(s) 125, and exhaust gases 127 are expelled from the combustion chamber 103 through exhaust runner(s) 129. The intake runners 125 may be in fluid communication with an intake manifold (not shown). The exhaust runners 129 may be in fluid communication with an exhaust manifold (not shown). Cylinder head 111 may integrate the exhaust manifold. A coolant jacket may include numerous interconnected passages containing engine coolant 115, and may be defined by passages 133 throughout the cylinder head including the exhaust manifold when integrated therewith. Substantial benefits to an integrated exhaust manifold configuration are known and include waste heat recovery during cold engine starts aiding in more rapidly attaining optimum in-cylinder combustion temperatures. Cylinder walls 109 may be formed directly in an iron casted engine block 113 or may include a cast iron sleeve pressed into an aluminum engine block, for example. Such sleeve configurations may be wet, wherein the outer sleeve surface is in direct contact with the engine coolant and defines part of the coolant jacket, or dry, wherein the outer sleeve surface is not in direct contact with the engine coolant with an intervening wall between the outer sleeve surface and the engine coolant. As used herein, the term cylinder wall is understood to mean the heat conductive structure substantially defining and between the interior of the combustion chamber and an engine coolant passage. Engine oil flows during engine operation through numerous oil galleries 136 located throughout the engine block as well known to those having ordinary skill in the art.

Internal combustion engine system 101 may include a control system architecture 135 including a plurality of electronic control units (ECU) 137 which may be communicatively coupled via a bus structure 139 to perform control functions and information sharing, including executing control routines locally and in distributed fashion. Bus structure 139 may include a Controller Area Network (CAN), as well known to those having ordinary skill in the art. One exemplary ECU may include an engine controller 145 primarily performing functions related to internal combustion engine monitoring, control and diagnostics based upon a plurality of inputs 150-160. While inputs 151-160 are illustrated as coupled directly to engine controller 145, the inputs may be provided to or within engine controller 145 from a variety of well-known sensors, calculations, derivations, synthesis, other ECUs and over the CAN or other bus structure 139 as well understood by those having ordinary skill in the art. The inputs include $T_{IM}$ 150, $T_o^{eoh}$ 151, $T_{c,in}^{eng}$ 152, $T_{c,out}^{eng}$ 153, $T_b^{eng}$ 154, FPC 155, APC 156, VSS 157, $\omega_{eng}$ 158, $T_{amb}$ 159, and $T_{c,out}^{eoh}$ 160, wherein:

$T_{IM}$ is the temperature of the intake manifold air, $T_o^{eoh}$ is the temperature of engine oil, $T_{c,in}^{eng}$, engine coolant in temperature, is the temperature of engine coolant entering the engine, $T_{c,out}^{eng}$, engine coolant out temperature, is the temperature of engine coolant exiting the engine, $T_b^{eng}$ is the temperature of the engine block, FPC is the fuel per cylinder, APC is the air per cylinder, VSS is speed of the vehicle, $\omega_{eng}$ is speed of the engine, $T_{amb}$ is the temperature of the ambient air, and $T^{eoh}_{c,out}$, engine oil heat exchanger coolant out temperature, is the temperature of engine coolant exiting the engine oil heat exchanger.

In one embodiment, at least engine coolant out temperature, engine block temperature and engine oil temperature are measured by respective sensors. In another embodiment, all temperature inputs are measured by respective temperature sensors.

With continued reference to FIG. 1, internal combustion engine system 101 is modeled as a plurality of heat transfers $\dot{Q}_{g,w}^{eng}$ 161, $\dot{Q}_{w,c}^{eng}$ 162, $\dot{Q}_{w,o}^{eoh}$ 163, $\dot{Q}_{c,b}^{eng}$ 164, $\dot{Q}_{b,a}^{eng}$ 165, and $\dot{Q}_{o,b}^{eoh}$ 167 as follows:

$\dot{Q}_{g,w}^{eng}$ is heat transfer from combustion gas to cylinder wall, $\dot{Q}_{w,c}^{eng}$ is heat transfer from cylinder wall to engine coolant, $\dot{Q}_{w,o}^{eoh}$ is heat transfer from cylinder wall (and piston head) to engine oil, $\dot{Q}_{c,b}^{eng}$ heat transfer from engine coolant to engine block, $\dot{Q}_{b,a}^{eng}$ heat transfer from engine block to ambient air, and $\dot{Q}_{eoh}^{o,b}$ is heat transfer from engine oil to engine block.

Figure 2:
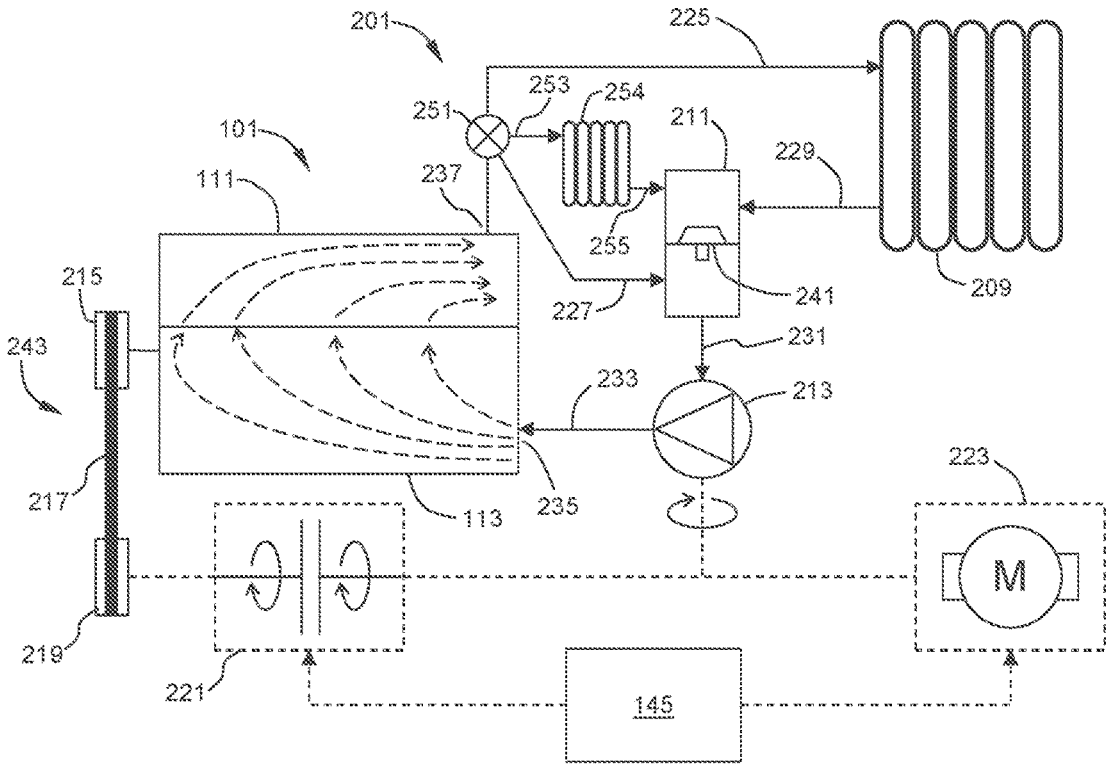
FIG. 2 illustrates an exemplary internal combustion engine cooling system, in accordance with the present disclosure.

FIG. 2 schematically illustrates an exemplary internal combustion engine cooling system 201 of the exemplary internal combustion engine system 101 of FIG. 1. Internal combustion engine system 101 includes engine block 113 and engine head 111 which may include an integrated exhaust manifold. Coolant is contained within the coolant jacket as described herein and flows when coolant pump 213 is rotated. Coolant is drawn into coolant pump 213 through coolant pump inlet hose 231 and exits pump 213 through engine inlet hose 233. Engine inlet hose may be fluidly coupled to an inlet 235 in the engine block 113. Coolant flows from the inlet hose 233 into the coolant jacket to flow through passages 131 surrounding each cylinder as described herein. From the engine block, the coolant flows through passages 133 throughout the cylinder head including the integrated exhaust manifold. The coolant may exit the engine through various outlets including, for example, a main outlet 237. Coolant may flow from the main outlet 237 to controllable rotary valve 251. Controllable rotary valve 251 may direct coolant flow to bypass hose 227, engine oil heat exchanger inlet hose 253, and radiator inlet hose 225. Coolant may flow through radiator inlet hose 225 and to and through radiator 209. Coolant may exit the radiator though radiator outlet hose 229 and flow to valve housing 211. Coolant may also flow through bypass hose 227, to and through valve housing 211, into coolant pump inlet hose 231. Coolant may flow through engine oil heat exchanger inlet hose 253 and to and through engine oil heat exchanger 254. Coolant may exit the engine oil heat exchanger 254 through engine oil heat exchanger outlet hose 255 and flow to valve housing 211. Valve housing 211, which may be incorporated within the head 111 or proximate thereto, may include a valve 241 for closing or opening a coolant path from radiator return hose 229 and engine oil heat exchanger outlet hose 255 to coolant pump 213 inlet hose 231. Valve 241 may be a thermostatically controlled valve. Alternatively, valve 241 may be an electrically controlled valve responsive to a control signal from engine controller 145 to open and close the control flow in the same manner as described herein with respect to a thermostatically controlled valve. Thus, it can be appreciated that when the coolant pump 213 is not rotating coolant is not flowing through the engine block 113 and engine head 111. When coolant pump 213 is rotating, coolant is flowing through the engine block 113 and engine head 111 at least in a recirculation mode through a bypass circuit including bypass hose 227 and valve housing 211. With coolant pump rotating, valve 241 open, and appropriate positioning of rotary valve 251, coolant is flowing through the engine block 113, engine head 111 and through a radiator circuit including main outlet 237, radiator inlet hose 225, radiator 209, radiator outlet hose 229, and valve housing 211. And, with coolant pump rotating, valve 241 open, and appropriate positioning of rotary valve 251, coolant is flowing through the engine block 113, engine head 111 and through an engine oil heat exchanger circuit including main outlet 237, engine oil heat exchanger inlet hose 253, engine oil heat exchanger 254, engine oil heat exchanger outlet hose 255, and valve housing 211. Pump 213 may be rotatively driven by an electric motor 223 or an accessory drive system 243. An electric motor 223 driving the coolant pump 213 is preferably capable of variable speed operation such that the coolant pump displacement may be variably controlled. An accessory drive system 243 driven coolant pump 213 may include a controllable clutch device 221 for controllably coupling the coolant pump 213 to the accessory drive system 243 including, for example, driven pully 219, drive pully 215 and accessory belt 217.

Figure 3:
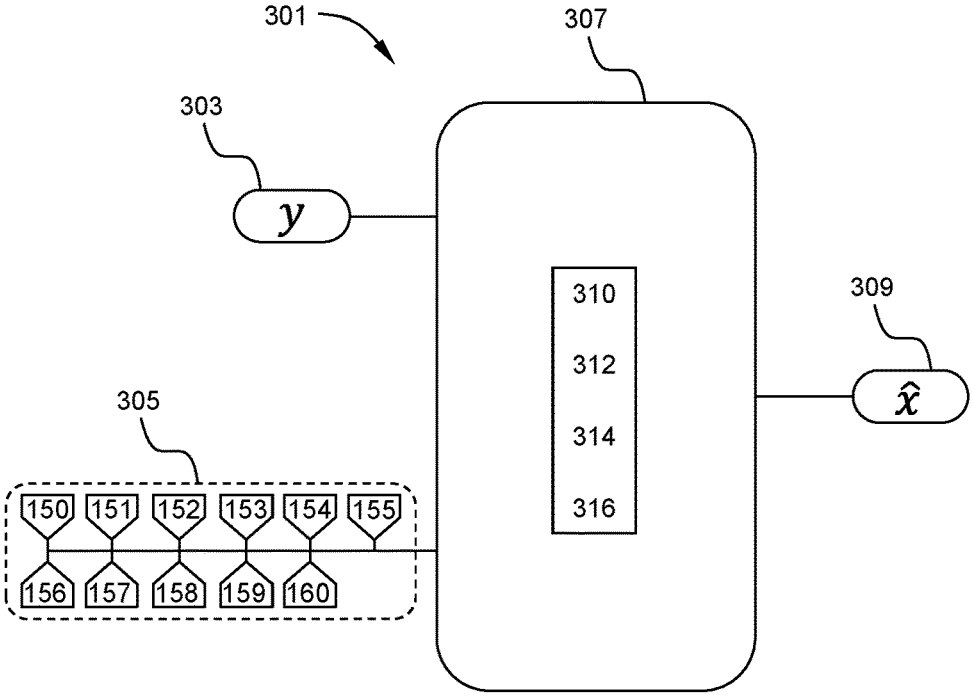
FIG. 3 illustrates a simplified schematic representation of a temperature state estimator configured for cylinder wall temperature estimation, in accordance with the present disclosure.

Direct measurements of internal combustion cylinder wall temperature through sensing technologies remains impractical outside of internal combustion engine research and development environments. In accordance with the present disclosure, cylinder wall temperature, $T_w^{eng}$, is accurately determinable using a thermal state model including a temperature state estimator. In one embodiment, the thermal state model is implemented during substantially static coolant flow conditions while engine coolant pumping is disabled. FIG. 3 illustrates a simplified schematic representation of a temperature state estimator 301 configured for cylinder wall temperature, $T_w^{eng}$, estimation based upon a first plurality (N) of measured system dynamic temperatures, y, 303, and multiple external variables 305 including $T_{IM}$ 150, $T_o^{eoh}$ 151, $T_{c,in}^{eng}$ 152, $T_{c,out}^{eng}$ t 153, $T_b^{eng}$ 154, FPC 155, APC 156, VSS 157, $\omega_{eng}$ 158, $T_{amb}$ 159, and $T_{c,out}$ 160 as set forth herein with respect to FIG. 1. The first plurality (N) of measured system dynamic temperatures (i.e. temperature state variables), y, 303, and the multiple external variables 305 are inputs to a thermal state model 307. The thermal state model 307 includes a second plurality (N+1) of temperature dynamics relationships (i.e. temperature state equations) 310, 312, 314, 316, and a corresponding second plurality (N+1) of estimated temperatures (i.e. state estimates), $\hat{x}$, 309. Thermal state model 307 may be implemented or executed as a software routine within the engine controller 145 (FIG. 1) or alternatively or additionally within one or more other ECU(s) 137 (FIG. 1). The first plurality (N) of measured system dynamic temperatures, y, 303 preferably includes the following vector of sensed temperature inputs:

$$y=[T_{c,out}^{eng}, T_b^{eng}, T_o^{eoh}].$$

The second plurality (N+1) of estimated temperatures, $\hat{x}$, 309 preferably includes the following vector of estimated temperature outputs:

$$\hat{x}=[\hat{T}_w^{eng}, \hat{T}_{c,out}^{eng}, \hat{T}_b^{eng}, \hat{T}_o^{eoh}].$$

The thermal state model 307 preferably includes a Kalman filter and associated gain. More particularly, a preferred Kalman filter is adapted for non-linear system dynamics, for example as an extended Kalman filter (EKF) or unscented Kalman filter (UKF). The second plurality (N+1) of temperature dynamics relationships (i.e. temperature state equations) 310, 312, 314, 316 are further discussed and developed herein.

In accordance with the present disclosure, a method and system for determining the cylinder wall temperature, $T_w^{eng}$, in the absence of a direct measurement, in an internal combustion engine includes a cylinder wall temperature dynamics relationship 310 of the thermal state model 307 of the temperature state estimator 301. Cylinder wall temperature dynamics relationship 310 includes defining a cylinder wall temperature dynamics relationship among the cylinder wall temperature, $T_w^{eng}$, and the primary heat transfers ($\dot{Q}$) associated with the cylinder wall as follows in Eq. [1]:

$$m_w^{eng} c_{pw}^{eng} \dot{T}_w^{eng} = -\dot{Q}_{w,c}^{eng} - \dot{Q}_{w,o}^{eng} + \dot{Q}_{g,w}^{eng} \quad [1]$$

wherein

- $m_w^{eng}$ is the mass of the cylinder wall,
- $c_{pw}^{eng}$ is the specific heat of the cylinder wall,
- $T_w^{eng}$ is the cylinder wall temperature,
- $\dot{Q}_{w,c}^{eng}$ heat transfer from cylinder wall to engine coolant,
- $\dot{Q}_{w,o}^{eng}$ heat transfer from cylinder wall to engine oil, and
- $\dot{Q}_{g,w}^{eng}$ heat transfer from combustion gas to cylinder wall.

The heat transfers are further defined in terms of respective, adjacent thermal medium temperature differentials in Eqs. [2]-[4] as follows:

$$\dot{Q}_{w,c}^{eng} = h_{w,c}^{eng} A_{w,c}^{eng} (T_w^{eng} - T_{c,out}^{eng}) \quad [2]$$

wherein

- $h_{w,c}^{eng}$ is the cylinder wall to coolant heat transfer coefficient,
- $A_{w,c}^{eng}$ is the cylinder wall to coolant interface surface area,
- $T_w^{eng}$ is cylinder wall temperature, and
- $T_{c,out}^{eng}$ is engine coolant out temperature.

$$\dot{Q}_{w,o}^{eoh} = h_{w,o}^{eoh} A_{w,o}^{eoh} (T_w^{eng} - T_o^{eoh}) \quad [3]$$

wherein

- $h_{w,o}^{eoh}$ is the cylinder wall to engine oil heat transfer coefficient,
- $A_{w,o}^{eoh}$ is the cylinder wall to engine oil interface surface area,
- $T_w^{eng}$ is cylinder wall temperature, and
- $T_o^{eoh}$ is engine oil temperature.

$$\dot{Q}_{g,w}^{eng} = h_{g,w}^{eng} A_{g,w}^{eng} (T_g^{eng} - T_w^{eng}) \quad [4]$$

wherein

- $h_{g,w}^{eng}$ is the combustion gas to cylinder wall heat transfer coefficient,
- $A_{g,w}^{eng}$ is the combustion gas to cylinder wall interface surface area,
- $T_g^{eng}$ is combustion gas temperature, and
- $T_w^{eng}$ is cylinder wall temperature.

It is assumed for present purposes that the heat transfer between the cylinder wall and the engine coolant is lossless because, among other things, the relatively low thermal mass of a thin cylinder wall and a substantially exclusive heat transfer path being between the cylinder wall and the engine coolant, the only other heat transfer paths at the cylinder wall being the relatively miniscule alternative paths at the fillets 122 (FIG. 1) at extreme upper and lower limits of passages 131 surrounding each cylinder. Thus, substitutions of the engine coolant heat transfer coefficient, engine coolant surface area, and engine coolant out temperature for corresponding cylinder wall quantities may be made, thus yielding the approximated heat transfer relationship Eq. [5] between the combustion gases and the cylinder wall. The rationale behind such assumptions and desirability of defining the approximated heat transfer relationship per Eq. [5] in terms related to engine coolant temperature includes the inherent difficulties in measuring the cylinder wall temperature, $T_w^{eng}$, particularly in a production intent internal combustion engine system. The approximated heat transfer relationship between the combustion gases and the cylinder wall may be expressed in Eq. [5], with the assumption of the lossless heat transfer between the cylinder wall and the engine coolant, as follows:

$$\dot{Q}_{g,w}^{eng}=h_{g,c}^{eng}A_{g,c}^{eng}(T_g^{eng}-T_{c,out}^{eng}) \quad [5]$$

wherein $h_{g,c}^{eng}$ is the equivalent combustion gas to engine coolant heat transfer coefficient, $A_{g,c}^{eng}$ is the equivalent combustion gas to engine coolant interface surface area, $T_g^{eng}$ is combustion gas temperature, and $T_{c,out}^{eng}$ is engine coolant out temperature.

It is recognized that the combined heat transfer coefficient and surface area term, $h_{g,c}^{eng}A_{g,c}^{eng}$, may be accurately approximated in accordance with engine specific parameters as well understood by those having ordinary skill in the art. This is done again with the reasonable assumption of lossless heat transfer between the cylinder wall and the engine coolant. As such, an equivalent term for the combined heat transfer coefficient and surface area term, $h_{g,c}^{eng}A_{g,c}^{eng}$ may be represented in Eq. [6] as follows:

$$h_{g,c}^{eng}A_{g,c}^{eng}=\frac{\pi Bk_g}{4}Nu \quad [6]$$

wherein

B is the cylinder bore diameter, $k_g$ is the thermal conductivity of the cylinder wall, and Nu is the Nusselt number.

The Nusselt number, Nu, may further be represented and determined in Eq. [7] as follows:

$$Nu=aRe^b \quad [7]$$

wherein

Re is the Reynolds number, and a and b are engine specific parameters which may be extrapolated from the relationship between the engine specific Nusselt number and the engine specific Reynolds number as well understood by those having ordinary skill in the art.

The Reynolds number is further defined in Eq. [8] as follows:

$$Re=\frac{4\dot{m}}{\pi\mu_g B} \quad [8]$$

wherein B is the cylinder bore diameter, $\dot{m}$ is the cylinder charge mass flow (FPC+APC), $\mu_g$ is the gas viscosity.

The thermal conductivity of the cylinder wall, $k_g$, and the gas viscosity, $\mu_g$, may be readily obtained by experiments in relation to the engine equivalence ratio during design and development of the particular engine as well understood by those having ordinary skill in the art. As well, the relationship between the Nusselt number, Nu, and the Reynolds number, Re, may be used to yield the engine specific parameters, a and b.

After having thus combined Eqs. [5]-[7] yielding Eq. [9] as follows:

$$\dot{Q}_{g,w}^{eng}=\frac{\pi Bk_g}{4}aRe^b(T_g^{eng}-T_{c,out}^{eng}), \quad [9]$$

and having thus determined from the engine specific parameters during design and development $$\frac{\pi Bk_g}{4}aRe^b,$$

attention is turned toward the bracketed temperature differential portion of Eq. [9]. Primary interest in accordance with the present disclosure is not with the relationship between combustion gas and engine coolant out temperatures, $T_g^{eng}$ and $T_{c,out}^{eng}$, but rather with the relation between combustion gas and cylinder wall temperatures, $T_g^{eng}$ and $T_w^{eng}$. However, measuring combustion gas temperature, $T_g^{eng}$, is also inherently difficult, particularly in a production intent internal combustion engine system. And, whereas the combustion gas to cylinder wall heat transfer and the combustion gas to engine coolant heat transfer are approximately equivalent, with the assumption of the lossless heat transfer between the cylinder wall and the engine coolant, accounting for the difference is still desirable for most accurate estimations in accordance with the present disclosure. Thus, Eq. [9] herein is advantageously modified by adding and subtracting the cylinder wall temperature, $T_w^{eng}$, as highlighted below by the underlined terms in Eq. [10]. The underlining of these terms carries no significance mathematically and is only included to draw attention to the now included terms.

$$\dot{Q}_{g,w}^{eng}=\frac{\pi Bk_g}{4}aRe^b\left(T_g^{eng}\underline{+T_w^{eng}}-T_{c,out}^{eng}\underline{-T_w^{eng}}\right) \quad [10]$$

The first three bracketed temperature terms from the right side of Eq. [10] are now aggregated into a combustion gas temperature correction term, $T_{g,corr}$, which is approximately equivalent to the combustion gas temperature, $T_g^{eng}$, but which accounts for the small temperature differential between the wall and the coolant, i.e., $T_w^{eng}-T_{c,out}^{eng}$. Thus, with a substitution of the combustion gas temperature correction term, $T_{g,corr}$, Eq. [10] may be restated as the following Eq. [11]:

$$\dot{Q}_{g,w}^{eng} = \frac{\pi B k_g}{4} a Re^b (T_{g,corr} - T_w^{eng}) \quad [11]$$

The cylinder wall temperature dynamics relationship Eq. [1], incorporating the cylinder wall to engine coolant and cylinder wall to engine oil heat transfer equivalents of Eqs. [2] and [3], respectively, and further incorporating the gas to wall heat transfer equivalent of Eq. [11], thus may be restated as the following cylinder wall temperature dynamics relationship in Eq. [12]:

$$m_w^{eng} c_{pw}^{eng} \dot{T}_w^{eng} = -h_{w,c}^{eng} A_{w,c}^{eng} (T_w^{eng} - T_{c,out}^{eng}) - h_{w,o}^{eoh} A_{w,o}^{eoh} (T_w^{eng} - T_o^{eoh}) + \frac{\pi B k_g}{4} a Re^b (T_{g,corr} - T_w^{eng}) \quad [12]$$

It is now desirable to determine the combustion gas temperature correction term, $T_{g,corr}$, as an intermediate step in rendering a solution for the cylinder wall temperature, $T_w^{eng}$, in accordance with the restated cylinder wall temperature dynamics relationship in Eq. [12]. For this, a change in combustion gas temperature, $\Delta T_g$, is modeled as the following Eq. [13]:

$$\Delta T_g = T_{g,corr} - T_{IM} \quad [13]$$

wherein $T_{IM}$ is the temperature of the intake manifold air.

The adiabatic temperature increase within an engine cylinder, $\Delta T_{adiab}$, is known from the following Eq. [14]:

$$\dot{m}_f c_{pg}^{exh} \Delta T_{adiab} = \dot{m}_{tot} C_{ghv} \quad [14]$$

wherein $\dot{m}_f$ is the fuel mass flow (i.e., FPC), $c_{pg}^{exh}$ is the specific heat of the exhaust gas, $\dot{m}_{tot}$ is the cylinder charge mass flow (i.e. FPC+APC), and $C_{ghv}$ is the fuel (gas) calorific heat.

Rearrangement of Eq. [14] and substitution of FPC and APC into the mass flows yield the adiabatic temperature increase within the engine cylinder, $\Delta T_{adiab}$, as follows:

$$\Delta T_{adiab} = \frac{\dot{m}_f C_{ghv}}{\dot{m}_{tot} c_{pg}^{exh}} = \frac{FPC}{APC + FPC} \frac{C_{ghv}}{c_{pg}^{exh}} \quad [15]$$

One having ordinary skill in the art recognizes that the term $$\frac{FPC}{APC + FPC}$$

expresses the fuel mass fraction of the cylinder charge which, if available as a control quantity, may be further substituted in its place.

The fraction of the adiabatic temperature increase within an engine cylinder contributing to the combustion gas temperature increase within the cylinder—which corresponds to the combustion gas temperature correction term, $T_{g,corr}$—may be defined in Eq. [16] as follows:

$$\alpha_{g,corr} := \frac{\Delta T_g}{\Delta T_{adiab}} := \frac{T_{g,corr} - T_{IM}}{\Delta T_{adiab}} \quad [16]$$

This fraction, $\alpha_{g,corr}$, may be referred to herein as the combustion adiabatic efficiency. Through substitutions and rearrangements using Eqs. [13]-[16] herein, an expression in Eq. [17] for the combustion gas temperature correction term, $T_{g,corr}$, is defined based in part upon the defined combustion adiabatic efficiency, $\alpha_{g,corr}$, as follows:

$$T_{g,corr} := T_{IM} + \alpha_{g,corr} \frac{C_{ghv}}{c_{pg}^{exh}} \frac{FPC}{APC + FPC} \quad [17]$$

Figure 4:
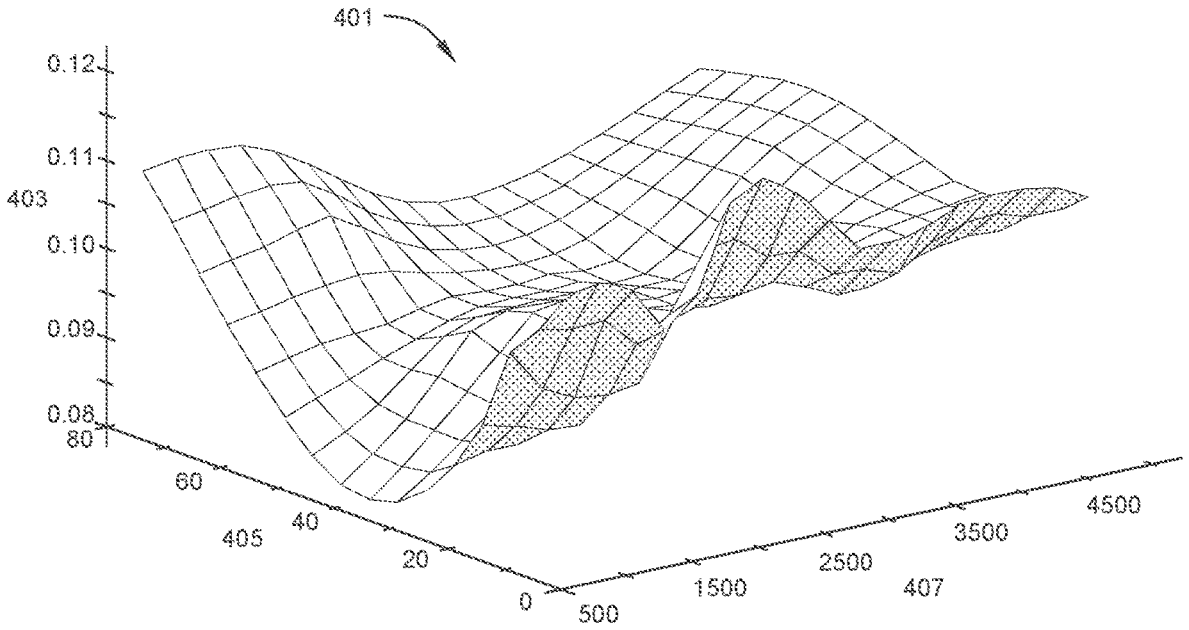
FIG. 4 illustrates an exemplary surface mapping representation of combustion adiabatic efficiency across the full range of engine speeds and fuel rates, in accordance with the present disclosure.

The combustion adiabatic efficiency, $$\alpha_{g,corr} := \frac{\Delta T_g}{\Delta T_{adiab}},$$

may be accurately assessed and determined on fully instrumented engines during full range performance assessments (FRaPA) conventionally performed during the pre-production engine development cycle. FIG. 4, for example, illustrates one such surface mapping representation 401 of the combustion adiabatic efficiency, $\alpha_{g,corr}$, 403 across the full range of engine speeds ($\omega_{eng}$) in RPM 407 and fuel rates (FPC) in mg/cyl/cycle 405 corresponding to, for example, one exemplary intake manifold air temperature ($T_{IM}$) of an exemplary internal combustion engine. Other such mappings for other intake manifold air temperatures may be performed during FRaPA of the exemplary engine and may include additional dimensions represented by other parameters in addition to engine speed, fuel rate and intake manifold air temperature, for example, atmospheric pressure, humidity, ambient temperature, variable fuels, charge air compression, etc. However, not all parameters have equal effect upon the combustion adiabatic efficiency, $\alpha_{g,corr}$, and one having ordinary skill in the art will be able to determine which, if any, additional parameters are advantageously considered for the purposes of the present disclosure. Additionally, various techniques for minimizing such calibration data sets may be employed as is well known and commonly practiced by those having ordinary skill in the art. It is envisioned that engine speed (VSS), fuel rate (FPC) and intake manifold air temperature ($T_{IM}$) parameters may provide adequate fidelity in the determination of the combustion adiabatic efficiency, $\alpha_{g,corr}$, in accordance with the present disclosure. Thus, calibration data sets correlating the combustion adiabatic efficiency, $\alpha_{g,corr}$, toengine speed ($\omega_{eng}$), fuel rate (FPC) and intake manifold air temperature($T_{IM}$), are made available in conjunction with Eq. [17] for the efficient determination of the combustion gas temperature correction term, $T_{g,corr}$, in accordance with the present disclosure. Preferably, the combustion adiabatic efficiency, $\alpha_{g,corr}$, is returned from one or more minimized datasets in the form of look-up tables referenced by engine speed ($\omega_{eng}$), fuel rate (FPC) and intake manifold air temperature ($T_{IM}$).

Thus, the fully defined form of the cylinder wall temperature dynamics relationship in Eq. [12], including the defined combustion gas temperature correction term, $T_{g,corr}$, including the defined combustion adiabatic efficiency, $\alpha_{g,corr}$, provides the cylinder wall temperature dynamics relationship 310, utilized in the thermal state model 307 of the temperature state estimator 301 (FIG. 3) to return the estimated cylinder wall temperature, $\hat{T}_w^{eng}$.

The remaining three temperature dynamics relationships 312, 314 and 316 utilized in the thermal state model 307 of the temperature state estimator 301 (FIG. 3) and returning estimated temperatures ($\hat{x}$) for engine coolant $\hat{T}_{c,out}^{eng}$, engine block $\hat{T}_b^{eng}$, and engine oil $\hat{T}_o^{eoh}$, respectively, are similarly developed in view of the respective primary heat transfers ($\dot{Q}$).

Engine coolant out temperature dynamics relationship 312 includes defining an engine coolant out temperature dynamics relationship as follows in Eq. [18]:

$$m_c^{eng} c_{pc}^{eng} \dot{T}_{c,out}^{eng} = \dot{m}_c^{eng} c_{pc}^{eng} (T_{c,in}^{eng} - T_{c,out}^{eng}) + \dot{Q}_{w,c}^{eng} - \dot{Q}_{c,b}^{eng} \quad [18]$$

wherein $m_c^{eng}$ is the mass of the engine coolant in the passages surrounding the cylinder wall, $c_{pc}^{eng}$ is the specific heat of the engine coolant, $\dot{m}_c^{eng}$ is the engine coolant mass flow, $T_{c,in}^{eng}$ is the engine coolant in temperature, $T_{c,out}^{eng}$ is the engine coolant out temperature, $\dot{Q}_{w,c}^{eng}$ is heat transfer from cylinder wall to engine coolant, and $\dot{Q}_{c,b}^{eng}$ heat transfer from engine coolant to engine block.

In accordance with the present disclosure, it is assumed that there is no engine coolant flow during the application of the thermal state model 307 of the temperature state estimator 301 (FIG. 3). Therefore, engine coolant mass flow, $\dot{m}_c^{eng}$, is assumed zero and the first term on the right side of Eq. [18] drops out as null. The remaining heat transfers, $\dot{Q}_{w,c}^{eng}$ and $\dot{Q}_{c,b}^{eng}$ are further defined in terms of respective, adjacent thermal medium temperature differentials in Eqs. [2] and [19] as follows:

$$\dot{Q}_{w,c}^{eng} = h_{w,c}^{eng} A_{w,c}^{eng} (T_w^{eng} - T_{c,out}^{eng}) \quad [2]$$

wherein $h_{w,c}^{eng}$ is the cylinder wall to coolant heat transfer coefficient, $A_{w,c}^{eng}$ is the cylinder wall to coolant interface surface area, $T_w^{eng}$ is cylinder wall temperature, and $T_{c,out}^{eng}$ is engine coolant out temperature.

$$\dot{Q}_{c,b}^{eng} = h_{c,b}^{eng} A_{c,b}^{eng} (T_{c,out}^{eng} - T_b^{eng}) \quad [19]$$

wherein $h_{c,b}^{eng}$ is the engine coolant to engine block heat transfer coefficient, $A_{c,b}^{eng}$ is the engine coolant to engine block interface surface area, $T_{c,out}^{eng}$ is engine coolant out temperature, and $T_b^{eng}$ is engine block temperature.

The engine coolant temperature dynamics relationship in Eq. [18] incorporating the cylinder wall to engine coolant and engine coolant to engine block heat transfer equivalents of Eqs. [2] and [19], respectively, thus may be restated as the following engine coolant out temperature dynamics relationship in Eq. [20]:

$$m_c^{eng} c_{pc}^{eng} \dot{T}_{c,out}^{eng} = h_{w,c}^{eng} A_{w,c}^{eng} (T_w^{eng} - T_{c,out}^{end}) - h_{c,b}^{eng} A_{c,b}^{eng} (T_{c,out}^{eng} - T_b^{eng}) \quad [20]$$

Thus, the fully defined form of the engine coolant temperature dynamics relationship in Eq. [20] provides the engine coolant out temperature dynamics relationship 312, utilized in the thermal state model 307 of the temperature state estimator 301 (FIG. 3) to return the estimated temperature ($\hat{T}_{c,out}^{eng}$) for the engine coolant out temperature, $T_{c,out}^{eng}$.

Engine block temperature dynamics relationship 314 includes defining an engine block temperature dynamics relationship as follows in Eq. [21]:

$$m_b^{eng} c_{pb}^{eng} \dot{T}_b^{eng} = \dot{Q}_{c,b}^{eng} + \dot{Q}_{o,b}^{eoh} - \dot{Q}_{b,a}^{eng} \quad [21]$$

wherein $m_b^{eng}$ is the mass of the engine block, $c_{eng}$ is the specific heat of the engine block, $T_b^{eng}$ is engine block temperature, $\dot{Q}_{c,b}^{eng}$ is heat transfer from engine coolant to engine block, $\dot{Q}_{o,b}^{eoh}$ is heat transfer from engine oil to engine block, and $\dot{Q}_{b,a}^{eng}$ is heat transfer from engine block to ambient air.

The heat transfers, $\dot{Q}_{c,b}^{eng}$, $\dot{Q}_{o,b}^{eoh}$, and $\dot{Q}_{b,a}^{eng}$ are further defined in terms of respective, adjacent thermal medium temperature differentials in Eqs. [19], [22] and [23] as follows:

$$\dot{Q}_{c,b}^{eng} = h_{c,b}^{eng} A_{c,b}^{eng} (T_{c,out}^{eng} - T_b^{eng}) \quad [19]$$

wherein $h_{c,b}^{eng}$ is the engine coolant to engine block heat transfer coefficient, $A_{c,b}^{eng}$ is the engine coolant to engine block interface surface area, $T_{c,out}^{eng}$ is engine coolant out temperature, and $T_b^{eng}$ is engine block temperature.

$$\dot{Q}_{o,b}^{eoh} = h_{o,b}^{eoh} A_{o,b}^{eoh} (T_o^{eoh} - T_b^{eng}) \quad [22]$$

wherein $h_{o,b}^{eoh}$ is the engine oil to engine block heat transfer coefficient, $A_{o,b}^{eoh}$ is the engine oil to engine block interface surface area, $T_o^{eoh}$ is engine oil temperature, and $T_b^{eng}$ is engine block temperature.

$$\dot{Q}_{b,a}^{eng} = h_{b,a}^{eng} A_{b,a}^{eng} (T_b^{eng} - T_{amb}) \quad [23]$$

wherein $h_{b,a}^{eng}$ is the engine block to ambient air heat transfer coefficient, $A_{b,a}^{eng}$ is the engine block to ambient air interface surface area, $T_b^{eng}$ is engine block temperature, and $T_{amb}$ is ambient air temperature.

The engine block temperature dynamics relationship in Eq. [21] incorporating the engine coolant to engine block, engine oil to engine block and engine block to ambient air heat transfer equivalents of Eqs. [19], [22] and [23], respectively, thus may be restated as the following engine block temperature dynamics relationship in Eq. [24]:

$$m_b^{eng} c_{pb}^{eng} \dot{T}_b^{eng} = h_{c,b}^{eng} A_{c,b}^{eng} (T_{c,out}^{eng} - T_b^{eng}) + h_{o,b}^{eoh} A_{o,b}^{eoh} (T_o^{eoh} - T_b^{eng}) - h_{b,a}^{eng} A_{b,a}^{eng} (T_b^{eng} - T_{amb}) \quad [24]$$

Thus, the fully defined form of the engine block temperature dynamics relationship in Eq. [24] provides the engine block temperature dynamics relationship 314, utilized in the thermal state model 307 of the temperature state estimator 301 (FIG. 3) to return the estimated temperature ($\hat{T}_b^{eng}$) for the engine block temperature, $T_b^{eng}$.

Engine oil temperature dynamics relationship 316 includes defining an engine oil temperature dynamics relationship as follows in Eq. [25]:

$$m_o^{eoh} c_{po}^{eng} \dot{T}_o^{eoh} = \dot{Q}_{w,o}^{eoh} + \dot{Q}_{c,o}^{eoh} + \dot{Q}_{b,o}^{eoh} + S_{fric} \quad [25]$$

wherein $m_o^{eoh}$ is the mass of the engine oil, $c_{po}^{eng}$ is the specific heat of the engine oil, $T_o^{eoh}$ is engine oil temperature, $\dot{Q}_{w,o}^{eoh}$ is heat transfer from cylinder wall to engine oil, $\dot{Q}_{c,o}^{eng}$ heat transfer from engine coolant to engine oil, $\dot{Q}_{b,o}^{eoh}$ is heat transfer from engine block to engine oil, and $S_{fric}$ is heat from mechanical friction imparted to the engine oil.

The heat transfers, $\dot{Q}_{w,o}^{eoh}$, $\dot{Q}_{c,o}^{eng}$, and $\dot{Q}_{b,o}^{eoh}$ are further defined in terms of respective, adjacent thermal medium temperature differentials in Eqs. [3], [26] and [27] as follows:

$$\dot{Q}_{w,o}^{eoh}=h_{w,o}^{eoh}A_{w,o}^{eoh}(T_w^{eng}-T_o^{eoh}) \quad [3]$$

wherein $h_{w,o}^{eoh}$ is the cylinder wall to engine oil heat transfer coefficient, $A_{w,o}^{eoh}$ is the cylinder wall to engine oil interface surface area, $T_w^{eng}$ is cylinder wall temperature, and $T_o^{eoh}$ is engine oil temperature.

$$\dot{Q}_{c,o}^{eoh}=h_{c,o}^{eoh}A_{c,o}^{eoh}(T_{c,out}^{eoh}-T_o^{eoh}) \quad [26]$$

wherein $h_{c,o}^{eoh}$ is the engine coolant to engine oil heat transfer coefficient, $A_{c,o}^{eoh}$ is the engine coolant to engine oil interface surface area, $T_{c,out}^{eoh}$, engine oil heat exchanger coolant out temperature, is the temperature of engine coolant exiting the engine oil heat exchanger, and $T_o^{eoh}$ is engine oil temperature.

$$\dot{Q}_{b,o}^{eoh}=h_{b,o}^{eoh}A_{b,o}^{eoh}(T_b^{eng}-T_o^{eoh}) \quad [27]$$

wherein $h_{b,o}^{eoh}$ is the engine block to engine oil heat transfer coefficient, $A_{b,o}^{eoh}$ is the engine block to engine oil interface surface area, $T_b^{eng}$ is engine block temperature, and $T_o^{eoh}$ is engine oil temperature.

The heat from mechanical friction, $S_{fric}$, is known to be a function of engine speed. Therefore, $S_{fric}$ may simply be referenced from a look-up table using engine speed, $\omega_{eng}$, as the independent reference variable to return $S_{fric}$. Such look-up table data may be determined during engine development and calibration, as well understood by one having ordinary skill in the art. The engine oil temperature dynamics relationship in Eq. [25] incorporating the cylinder wall to engine oil, engine coolant to engine oil and engine block to engine oil heat transfer equivalents of Eqs. [3], [26] and [27], respectively, thus may be restated as the following engine oil temperature dynamics relationship in Eq. [28]:

$$m_o^{eoh}c_{po}^{eng}\dot{T}_o^{eoh}=h_{w,o}^{eoh}A_{w,o}^{eoh}(T_w^{eng}-T_o^{eoh})+h_{c,o}^{eoh}A_{c,o}^{eoh}(T_{c,out}^{eoh}-T_{c,out}^{eoh}-T_o^{eoh})+h_{b,o}^{eo}{}_{h}A_{b,o}^{eoh}(T_b^{eng}-T_o^{eoh})+S_{fric} \quad [28]$$

Thus, the fully defined form of the engine oil temperature dynamics relationship in Eq. [28] provides the engine oil temperature dynamics relationship 316, utilized in the thermal state model 307 of the temperature state estimator 301 (FIG. 3) to return the estimated temperature ($\hat{T}_o^{eoh}$) for the engine oil temperature, $T_o^{eoh}$.

Figure 5:
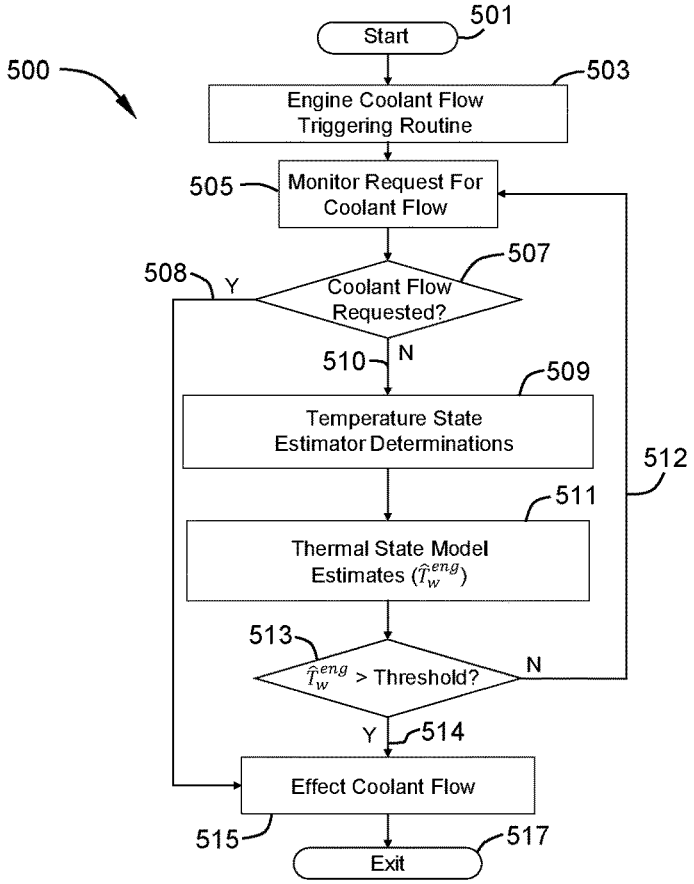
FIG. 5 illustrates an exemplary flowchart of a process triggering coolant flow in accordance with the present disclosure.

FIG. 5 illustrates an exemplary flowchart 500 of a process triggering coolant flow in accordance with the present disclosure. With additional reference to FIGS. 1 and 2, rapid attainment of optimal combustion conditions within the combustion chambers 103 of the internal combustion engine system 101 is enabled by maintaining static conditions related to coolant flow. However, once such combustion conditions are attained, coolant may be desirably circulated, including for example to radiator 209 and engine oil heat exchanger 254 to prevent undesirable thermal events within the engine. The flowchart 500 is representative of steps which may be carried out via executable software routines, for example, within engine controller 145. The process may initiate upon starting the internal combustion engine (501) after which the engine coolant flow triggering routine is entered (503). Request for coolant flow may be ongoingly monitored (505), such as through repetitive scheduled checks, events driven checks, calls, or the like, and if requested (507), (508) then coolant flow may be effected (515). In accordance with the present disclosure, coolant flow may be effected by rotating pump 213 (FIG. 2) as set forth herein. Subsequent to effecting coolant flow, coolant flow may initially be limited to engine recirculation via bypass circuit as set forth herein. With additional reference to FIG. 2, flow control may be effected by valve 241 and rotary valve 251 through radiator 209, engine oil heat exchanger 254, or other coolant circuits such as, for example, a passenger compartment heater core (not shown). After coolant flow is effected (515), the routine may be exited (517). Subsequent to request for coolant flow monitoring (505), if coolant flow is not requested (507), (510), then the temperature state estimator 301 (FIG. 3) determinations in accordance with the present disclosure may be ongoingly performed. External variables 305 (FIG. 3) may be provided to the thermal state model 307 (FIG. 3) at (509). The thermal state model 307 may return, among other estimates, the estimated cylinder wall temperature, $\hat{T}_w^{eng}$ at (511). A comparison of the estimated cylinder wall temperature, $\hat{T}w^{eng}$ to a predetermined trigger threshold may be made at (513). When the estimated cylinder wall temperature, $\hat{T}_w^{eng}$ exceeds the triggering threshold (513), (514), coolant flow may be requested and effected at (515). Otherwise, when the estimated cylinder wall temperature, $\hat{T}_w^{eng}$ does not exceed the triggering threshold (513), (512), the routine may ongoingly monitor requests for coolant flow (505).

Unless explicitly described as being "direct," when a relationship between first and second elements is described in the above disclosure, that relationship can be a direct relationship where no other intervening elements are present between the first and second elements, but can also be an indirect relationship where one or more intervening elements are present (either spatially or functionally) between the first and second elements.

It should be understood that one or more steps within a method may be executed in different order (or concurrently) without altering the principles of the present disclosure. Further, although each of the embodiments is described above as having certain features, any one or more of those features described with respect to any embodiment of the disclosure can be implemented in and/or combined with features of any of the other embodiments, even if that combination is not explicitly described. In other words, the described embodiments are not mutually exclusive, and permutations of one or more embodiments with one another remain within the scope of this disclosure.

While the above disclosure has been described with reference to exemplary embodiments, it will be understood by those skilled in the art that various changes may be made and equivalents may be substituted for elements thereof without departing from its scope. In addition, many modifications may be made to adapt a particular situation or material to the teachings of the disclosure without departing from the essential scope thereof. Therefore, it is intended that the present disclosure not be limited to the particular embodiments disclosed, but will include all embodiments falling within the scope thereof

What is claimed is:

1. A method for controlling an internal combustion engine including an engine block, a combustion cylinder including a cylinder wall, engine oil and a coolant pump for controllably circulating engine coolant, comprising:

estimating, while the engine is operating and the coolant pump is disabled to establish static coolant flow conditions, the cylinder wall temperature with a thermal state model including a temperature state estimator, the temperature state estimator comprising a plurality of temperature state equations based upon modeled heat transfers within the internal combustion engine, the plurality of temperature state equations comprising:

a cylinder wall temperature state equation comprising a combustion gas to cylinder wall heat transfer term based upon a fraction of an adiabatic temperature increase within the cylinder contributing to a combustion gas temperature increase within the cylinder wherein the cylinder wall temperature state equation comprises:

$$m_w^{eng} c_{pw}^{eng} \dot{T}_w^{eng} = -\dot{Q}_{w,c}^{eng} - \dot{Q}_{w,o}^{eoh} + \dot{Q}_{g,w}^{eng}$$

wherein $m_w^{eng}$ comprises the mass of the cylinder wall, $c_{pw}^{eng}$ comprises the specific heat of the cylinder wall, $\dot{T}_w^{eng}$ comprises cylinder wall temperature, $\dot{Q}_{w,c}^{eng}$ comprises heat transfer from the cylinder wall to the engine coolant, $\dot{Q}_{w,o}^{eoh}$ comprises heat transfer from the cylinder wall to the engine oil, and $\dot{Q}_{g,w}^{eng}$ comprises heat transfer from combustion gas to the cylinder wall determined in accordance with the following relationship:

$$\frac{\pi B k_g}{4} a Re^b (T_{g,corr} - T_w^{eng})$$

wherein B comprises the cylinder bore diameter, $k_g$ comprises the thermal conductivity of the cylinder wall, Re comprises the Reynolds number, a and b comprise engine specific parameters, and $T_{g,corr}$ comprises a combustion gas temperature correction term based in part upon the fraction of the adiabatic temperature increase within the cylinder contributing to the combustion gas temperature increase within the cylinder; and an engine coolant out temperature state equation based upon static coolant flow conditions;

comparing the estimated cylinder wall temperature to a predetermined temperature threshold; and enabling the coolant pump for circulating the engine coolant in the engine when the estimated cylinder wall temperature exceeds the predetermined temperature threshold.

2. The method of claim 1, wherein the engine coolant out temperature state equation assuming no coolant flow comprises:

$$m_c^{eng} c_{pc}^{eng} \dot{T}_{c,out}^{eng} = \dot{Q}_{w,c}^{eng} - \dot{Q}_{c,b}^{eng}$$

wherein $m_c^{eng}$ comprises the mass of the engine coolant surrounding the cylinder wall, $C_{pc}^{eng}$ comprises the specific heat of the engine coolant, $\dot{T}_{c,out}^{eng}$ comprises engine coolant out temperature change, $\dot{Q}_{w,c}^{eng}$ comprises heat transfer from the cylinder wall to the engine coolant, and $\dot{Q}_{c,b}^{eng}$ comprises heat transfer from the engine coolant to the engine block.

3. The method of claim 1, wherein the plurality of temperature state equations further comprises:

an engine block temperature state equation $$m_b^{eng} c_{pb}^{eng} \dot{T}_b^{eng} = \dot{Q}_{c,b}^{eng} + \dot{Q}_{o,b}^{eoh} - \dot{Q}_{b,a}^{eng}$$

wherein $m_b^{eng}$ comprises the mass of the engine block, $c_{pb}^{eng}$ comprises the specific heat of the engine block, $\dot{T}_b^{eng}$ comprises engine block temperature change, $\dot{Q}_{c,b}^{eng}$ comprises heat transfer from the engine coolant to the engine block, $\dot{Q}_{o,b}^{eoh}$ comprises heat transfer from the engine oil to the engine block, and $\dot{Q}_{b,a}^{eng}$ comprises heat transfer from the engine block to ambient air.

4. The method of claim 1, wherein the plurality of temperature state equations further comprises:

an engine oil temperature dynamics relationship $$m_o^{eoh} c_{po}^{eng} \dot{T}_o^{eoh} = \dot{Q}_{w,o}^{eoh} + \dot{Q}_{c,o}^{eoh} + \dot{Q}_{b,o}^{eoh+S_{fric}}$$

wherein $m_o^{eoh}$ comprises the mass of the engine oil, $c_{po}^{eng}$ comprises the specific heat of the engine oil, $\dot{T}_o^{eoh}$ comprises engine oil temperature change, $\dot{Q}_{w,o}^{eoh}$ comprises heat transfer from cylinder wall to engine oil, $\dot{Q}_{c,o}^{eng}$ comprises heat transfer from engine coolant to engine oil, $\dot{Q}_{b,o}^{eoh}$ comprises heat transfer from engine block to engine oil, and $S_{fric}$ comprises heat from mechanical friction imparted to the engine oil.

5. A method for controlling an internal combustion engine including an engine block, a combustion cylinder including a cylinder wall, engine oil and a coolant pump for controllably circulating engine coolant, comprising:

modeling the internal combustion engine as a plurality of heat transfers;

defining a plurality of temperature state equations based upon the plurality of heat transfers;

measuring a plurality of temperature state variables;

implementing, within a controller while the engine is operating and the coolant pump is disabled to establish static coolant flow conditions, a thermal state model providing an estimated cylinder wall temperature, the thermal state model comprising the plurality of temperature state equations including receiving the plurality of temperature state variables, the plurality of temperature state equations comprising:

a cylinder wall temperature state equation comprising a combustion gas to cylinder wall heat transfer term based upon a fraction of an adiabatic temperature increase within the cylinder contributing to a combustion gas temperature increase within the cylinder wherein the cylinder wall temperature state equation comprises:

$$m_w^{eng} c_{pw}^{eng} \dot{T}_w^{eng} = -\dot{Q}_{w,c}^{eng} - \dot{Q}_{w,o}^{eoh} + \dot{Q}_{g,w}^{eng}$$

wherein $m_w^{eng}$ comprises the mass of the cylinder wall, $c_{pw}^{eng}$ comprises the specific heat of the cylinder wall, $\dot{T}_w^{eng}$ comprises cylinder wall temperature, $\dot{Q}_{w,c}^{eng}$ comprises heat transfer from the cylinder wall to the engine coolant, $\dot{Q}_{w,o}^{eoh}$ comprises heat transfer from the cylinder wall to an engine oil, and $\dot{Q}_{g,w}^{eng}$ comprises heat transfer from combustion gas to the cylinder wall determined in accordance with the following relationship:

$$\frac{\pi B k_g}{4} a Re^b (T_{g,corr} - T_w^{eng})$$

wherein B comprises the cylinder bore diameter, $k_g$ comprises the mass of the cylinder wall, Re comprises the Reynolds number, a and b comprise engine specific parameters, and comprises the specific heat of the cylinder wall, $T_{g,corr}$ comprises a combustion gas temperature correction term based in part upon the fraction of the adiabatic temperature increase with the cylinder contributing to the combustion gas temperature increase within the cylinder;

an engine coolant out temperature state equation based upon static coolant flow conditions; and controlling the coolant pump to circulate engine coolant in the internal combustion engine based upon the estimated cylinder wall temperature.

6. The method of claim 5, wherein the engine coolant out temperature state equation assuming no coolant flow comprises:

$$m_c^{eng} c_{pc}^{eng} \dot{T}_{c,out}^{eng} = \dot{Q}_{w,c}^{eng} - \dot{Q}_{c,b}^{eng}$$

wherein $m_c^{eng}$ comprises the mass of the engine coolant in the passages surrounding the cylinder wall, $C_{pc}^{eng}$ comprises the specific heat of the engine coolant, $\dot{T}_{c,out}^{eng}$ comprises engine coolant out temperature change, $\dot{Q}_{w,c}^{eng}$ comprises heat transfer from the cylinder wall to the engine coolant, and $\dot{Q}_{c,b}^{eng}$ comprises heat transfer from the engine coolant to the engine block.

7. The method of claim 5, wherein the plurality of temperature state equations further comprises:

an engine block temperature state equation $$m_b^{eng} c_{pb}^{eng} \dot{T}_b^{eng} = \dot{Q}_{c,b}^{eng} + \dot{Q}_{o,b}^{eoh} - \dot{Q}_{b,a}^{eng}$$

wherein $m_b^{eng}$ comprises the mass of the engine block, $c_{pb}^{eng}$ comprises the specific heat of the engine block, $\dot{T}_b^{eng}$ comprises engine block temperature change, $\dot{Q}_{c,b}^{eng}$ comprises heat transfer from the engine coolant to the engine block, $\dot{Q}_{o,b}^{eoh}$ comprises heat transfer from the engine oil to the engine block, and $\dot{Q}_{b,a}^{eng}$ comprises heat transfer from the engine block to ambient air.

8. The method of claim 5, wherein the plurality of temperature state equations further comprises:

an engine oil temperature dynamics relationship $$m_o^{eoh} c_{po}^{eng} \dot{T}_o^{eoh} = \dot{Q}_{w,o}^{eoh} + \dot{Q}_{c,o}^{eoh} + \dot{Q}_{b,o}^{eoh+S_{fric}}$$

wherein $m_o^{eoh}$ comprises the specific heat of the engine oil, $c_{po}^{eng}$ comprises the specific heat of the engine oil, $\dot{T}_o^{eoh}$ comprises engine oil temperature change, $\dot{Q}_{w,o}^{eoh}$ comprises heat transfer from the cylinder wall to engine oil, $\dot{Q}_{c,o}^{eng}$ comprises heat transfer from engine coolant to engine oil, $\dot{Q}_{b,o}^{eoh}$ comprises heat transfer from engine block to engine oil, and $S_{fric}$ comprises heat from mechanical friction imparted to the engine oil.

9. An apparatus for controlling an internal combustion engine including an engine block, a combustion cylinder including a cylinder wall, engine oil and engine coolant, comprising:

an engine coolant pump;

an engine block temperature sensor for measuring an engine block temperature;

an engine coolant out temperature sensor for measuring an engine coolant out temperature;

an engine oil temperature sensor for measuring an engine oil temperature; and a control module executing, while the engine is operating and the engine coolant pump is disabled to establish static coolant flow conditions, a thermal state model comprising the engine block temperature, the engine coolant out temperature and the engine oil temperature as state variable inputs, the thermal state model comprising a temperature state estimator comprising a plurality of temperature state equations including a cylinder wall temperature state equation comprising a combustion gas to a cylinder wall heat transfer term based upon a fraction of an adiabatic temperature increase within the cylinder contributing to a combustion gas temperature increase within the cylinder and an engine coolant out temperature state equation based upon static coolant flow conditions, the thermal state model providing an estimated cylinder wall temperature, the control module controlling the engine coolant pump based upon the estimated cylinder wall temperature.

10. The apparatus of claim 9, wherein the cylinder wall temperature state equation comprises:

$$m_w^{eng} c_{pw}^{eng} \dot{T}_w^{eng} = -\dot{Q}_{w,c}^{eng} - \dot{Q}_{w,o}^{eoh} + \dot{Q}_{g,w}^{eng}$$

wherein $m_w^{eng}$ comprises the mass of the cylinder wall, $c_{pw}^{eng}$ comprises the specific heat of the cylinder wall, $\dot{T}_w^{eng}$ comprises cylinder wall temperature change, $\dot{Q}_{w,c}^{eng}$ comprises heat tranfer from the cylinder wall to the engine coolant, $\dot{Q}_{w,o}^{eoh}$ comprises heat transfer from the cylinder wall to the engine oil, and $\dot{Q}_{g,w}^{eng}$ comprises heat transfer from combustion gas to the cylinder wall determined in accordance with the following relationship:

$$\frac{\pi B k_g}{4} a Re^b (T_{g,corr} - T_w^{eng})$$

wherein B comprises the cylinder bore diameter, $k_g$ comprises the thermal conductivity of the cylinder wall, Re comprises the Reynolds number, a and b comprise engine specific parameters, and $T_{g,corr}$ comprises a combustion gas temperature correction term based in part upon a fraction of the adiabatic temperature increase within the cylinder contributing to the combustion gas temperature increase within the cylinder.

11. The apparatus of claim 9, wherein the thermal state model comprises an extended Kalman filter.

12. The apparatus of claim 9, wherein the engine coolant out temperature state equation based upon static coolant flow conditions comprises:

$$m_c^{eng} c_{pc}^{eng} \dot{T}_{c,out}^{eng} = \dot{Q}_{w,c}^{eng} - \dot{Q}_{c,b}^{eng}$$

wherein $m_c^{eng}$ comprises the mass of the engine coolant in the passages surrounding the cylinder wall, $c_{pc}^{eng}$ comprises the specific heat of the engine coolant, $\dot{T}_{c,out}^{eng}$ comprises engine coolant out temperature change, $\dot{Q}_{w,c}^{eng}$ comprises heat transfer from the cylinder wall to the engine coolant, and $\dot{Q}_{c,b}^{eng}$ comprises heat transfer from the engine coolant to the engine block.

13. The method of claim 9, wherein the plurality of temperature state equations further comprises:

an engine block temperature state equation $$m_b^{eng} c_{pb}^{eng} \dot{T}_b^{eng} = \dot{Q}_{c,b}^{eng} + \dot{Q}_{o,b}^{eoh} - \dot{Q}_{b,a}^{eng}$$

wherein $m_b^{eng}$ comprises the mass of the engine block, $c_{pb}^{eng}$ comprises the specific heat of the engine block, $\dot{T}_b^{eng}$ comprises engine block temperatrure change, $\dot{Q}_{c,b}^{eng}$ comprises heat transfer from the engine coolant to the engine block, $\dot{Q}_{o,b}^{eoh}$ comprises heat transfer from the engine oil to the engine block, and $\dot{Q}_{b,a}^{eng}$ comprises heat transfer from the engine block to ambient air.

14. The method of claim 9, wherein the plurality of temperature state equations further comprises:

an engine oil temperature dynamics relationship $$m_o^{eoh} c_{po}^{eng} \dot{T}_o^{eoh} = \dot{Q}_{w,o}^{eoh} + \dot{Q}_{c,o}^{eoh} + \dot{Q}_{b,o}^{eoh} + S_{fric}$$

wherein $m_o^{eoh}$ comprises the mass of the engine oil, $c_{po}^{eng}$ comprises the specific heat of the engine oil, $\dot{T}_o^{eoh}$ comprises engine oil temperature change, $\dot{Q}_{w,o}^{eoh}$ comprises heat transfer from the cylinder wall to engine oil, $\dot{Q}_{c,o}^{eng}$ comprises heat transfer from engine coolant to engine oil, $\dot{Q}_{b,o}^{eoh}$ comprises heat transfer from engine block to engine oil, and $S_{fric}$ comprises heat from mechanical friction imparted to the engine oil.

* * * * *